US007055467B2

(12) United States Patent
Yi

(10) Patent No.: US 7,055,467 B2
(45) Date of Patent: Jun. 6, 2006

(54) COOLING SYSTEM FOR AN ENGINE

(75) Inventor: Jea-Woong Yi, Gwangju Metropolitan (KR)

(73) Assignee: Hyundai Motor Company, Seoul (KR)

( * ) Notice: Subject to any disclaimer, the term of this patent is extended or adjusted under 35 U.S.C. 154(b) by 67 days.

(21) Appl. No.: 10/749,211

(22) Filed: Dec. 30, 2004

(65) Prior Publication Data

US 2004/0261730 A1 Dec. 30, 2004

(30) Foreign Application Priority Data

May 19, 2003 (KR) ..... 10-2003-0031576

(51) Int. Cl.
*F01P 3/00* (2006.01)

(52) U.S. Cl. ..... 123/41.29; 236/101 C

(58) Field of Classification Search ..... 123/41.29; 236/101 C

See application file for complete search history.

(56) References Cited

U.S. PATENT DOCUMENTS 6,595,164 B1 * 7/2003 Kunze et al. ..... 123/41.1

2003/0079699 A1 * 5/2003 Hwang ..... 123/41.05

* cited by examiner

*Primary Examiner*—Noah P. Kamen
(74) *Attorney, Agent, or Firm*—Morgan Lewis & Bockius LLP

(57) ABSTRACT

A cooling system for an engine wherein a cylinder block side is mounted with a stagnation chamber for detaining, around a temperature-sensing unit of a sub-thermostat, a portion of cooling water discharged to a high temperature passage via an outlet of a cooling water passage of the cylinder block side such that the opening and closing of the sub-thermostat is modulated by the temperature of the cooling water at the cylinder block side. The cooling system includes a main thermostat and a sub-thermostat for individually controlling the flow of cooling water in a cylinder block and a cylinder head. The stagnation chamber, where cooling water discharged from the cylinder block is stagnated, is installed inside a sub-thermostat housing, i.e. where a sub-thermostat is mounted. The stagnation chamber is positioned therein with a temperature-sensing unit. The stagnation chamber communicates with a cooling water discharge passage of the cylinder head via a confluence passage.

8 Claims, 2 Drawing Sheets

COOLING SYSTEM FOR AN ENGINE

CROSS-REFERENCE TO RELATED APPLICATIONS

This application claims priority of Korean Patent Application No. 10-2003-0031576, filed on May 19, 2003, the disclosure of which is incorporated by reference herein.

FIELD OF THE INVENTION

The present invention provides a cooling system for an engine and, more specifically, a cooling system for an engine configured to change a mounting structure of a sub-thermostat mounted at an outlet of a cooling water passage at a cylinder block side to enable the opening and closing of the sub-thermostat accurately in response to the cooling water temperature at the cylinder block side. Also disclosed is a separate cooling system, wherein a main thermostat and a sub-thermostat are used to separately carry out the function of cooling a cylinder block and a cylinder head.

BACKGROUND OF THE INVENTION

Generally, a cooling system for an engine in a vehicle allows the engine to maintain a normal operating temperature under all running conditions and all speed ranges. This is to prevent thermal damage to the cylinder block, cylinder head, piston and other parts in temperatures of approximately 2,500° C. that is generated by the combustion of fuel-air mixture in a combustion chamber.

In a cooling system using the separate cooling method, as described in the prior art, the sub-thermostat is mounted with a temperature-sensing bulb (sealed therein with wax) exposed to an outlet of a cooling water passage at the cylinder head side to modulate the opening and closing in response to the temperature of the cooling water. As a result, the opening and closing occurs in response to the temperature of the cooling water at the cylinder head side rather than the temperature of cooling water at the cylinder block side.

This problem is caused by a phenomenon where leaking cooling water at the cylinder block side cannot stay around a temperature-sensing bulb of the sub-thermostat by flow of the cooling water discharged to a high temperature passage from the cylinder head side when the cooling water at the cylinder block side is discharged to the high temperature passage connected to a radiator via a leaking passage mounted at the sub-thermostat.

As a result, a problem arises where a sub-thermostat, opened by a pressure difference of approximately 0.6 bar between a cylinder block and a cylinder head, is closed when the temperature of cooling water at the cylinder head side suddenly drops while the temperature of the cooling water at the cylinder block side is high as in the case where a vehicle ascends and descends on a steep hill, thereby preventing the cooling water in the cylinder block from flowing, ultimately causing thermal damage to the cylinder block.

SUMMARY OF THE INVENTION

Embodiments of the present invention provide a cooling system for an engine that is configured to installs at the cylinder block side, a stagnation chamber for detaining around a temperature-sensing unit some of the cooling water discharged to the high temperature passage via an outlet of a cooling water passage at the cylinder block side. In consequence, the opening and closing of the sub-thermostat will be effected only by the temperature of the cooling water at the cylinder block side.

A preferred embodiment of the present invention provides a cooling system for an engine equipped with a main thermostat and a sub-thermostat for individually controlling the flow of cooling water in a cylinder block and a cylinder head, wherein a stagnation chamber, where cooling water discharged from said cylinder block remains stagnant, is installed inside a sub-thermostat housing mounted with a sub-thermostat, and said stagnation chamber is positioned therein with a temperature sensing unit of said sub-thermostat and said stagnation chamber communicates with a cooling water discharge passage of said cylinder head via a confluence passage.

Another embodiment of the present invention provides a cooling system for an engine mounted with a main thermostat and a sub-thermostat for individually controlling the flow of cooling water in a cylinder block and a cylinder head, wherein a sub-thermostat housing mounted with said sub-thermostat is formed with a confluence passage communicating with a cooling water discharge passage of said cylinder head, and a through hole formed at a valve seat of said sub-thermostat is oppositely formed from the cooling water discharge passage of said cylinder head.

BRIEF DESCRIPTION OF THE DRAWINGS

For a better understanding of the present invention, reference should be made to the following detailed description of the accompanying drawings, in which.

DETAILED DESCRIPTION OF THE PREFERRED EMBODIMENT

The preferred embodiment of the present invention will now be described in detail with reference to the accompanying drawings.

Figure 1:
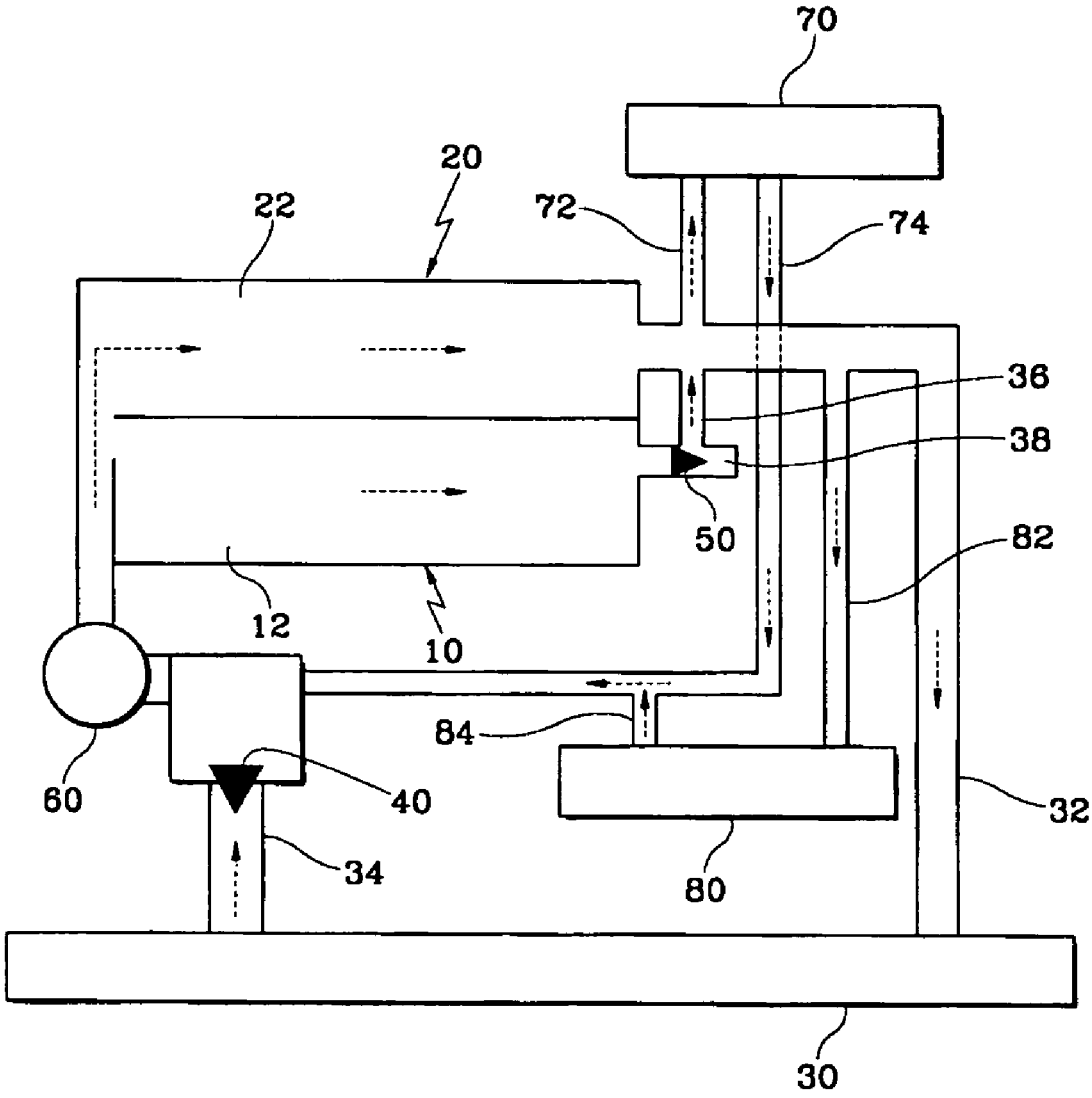
FIG. 1 is a block diagram of a cooling system for an engine where a separation cooling system is applied according to an embodiment of the present invention.
Figure 2:
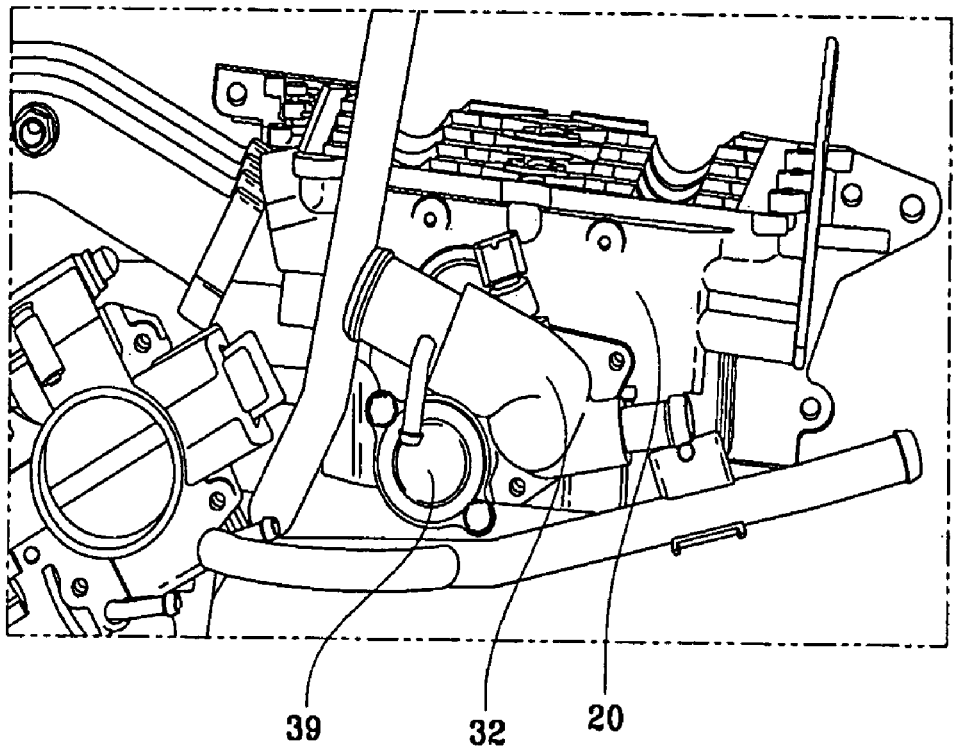
FIG. 2 is a perspective view which illustrates the portion where a sub-thermostat shown in FIG. 1 is mounted.

The present invention provides a cooling system for an engine where a separation cooling system is applied, a structure of which is illustrated in FIGS. 1 and 2. The cylinder block 10 and a cylinder head 20 are respectively formed with a first cooling water passage 12 and a second cooling water passage 22 for promoting flow of cooling water. The first and second cooling water passage 12 and 22 are generally called water jackets and respectively encompass a cylinder and a combustion chamber. In addition, the first and second cooling water passage 12 and 22 can be connected to a radiator 30 for cooling the cooling water by heat exchange with atmospheric air via a high temperature passage 32 and a low temperature passage 34, thereby enabling circulation of the cooling water. Furthermore, the low temperature passage 34 can be equipped with a main thermostat 40 for controlling the flow of the cooling water in response to a temperature of approximately 82 degrees Celsius, and the first cooling water passage 12 can be mounted at an outlet side thereof with a sub-thermostat 50 for controlling the flow of the cooling water in response to a temperature of approximately 95 degrees Celsius and a pressure difference (approximately 0.6 bar) between the first cooling water passage 12 and the second cooling water passage 22.

The sub-thermostat 50 is formed inside a flow passage for enabling a communication between an outlet of the first cooling water passage 12 and a portion where the second cooling water passage 22 and the high temperature passage 32 are connected. The low temperature passage 34 is formed at an outlet side thereof with a water pump 60 for outputting the cooling water, and between the high temperature passage 32 and the water pump 60, there are respectively formed supply pipes 72 and 82 and recovery pipes 74 and 84 for enabling circulation of the cooling water with a heater 70 and a throttle body 80.

Figure 3:
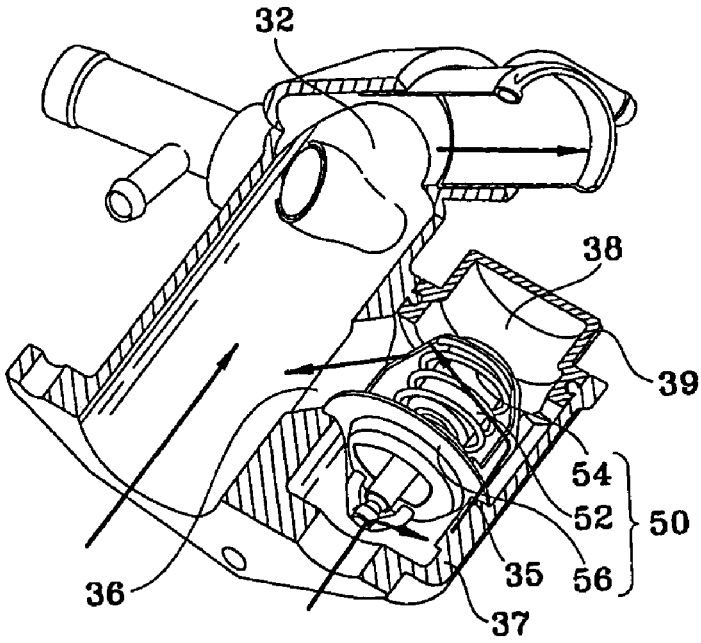
FIG. 3 is an exploded perspective view of a structure with regard to a discharge passage of cooling water at a cylinder block side where a sub-thermostat is mounted.

Meanwhile, as mentioned in the foregoing, the sub-thermostat 50 is mounted on the branch channel 36 connecting the first cooling water passage 12 and the high temperature passage 32, a structure of which will be illustrated in detail in FIG. 3.

A sub-thermostat housing 37 in which the sub-thermostat 50 is mounted is provided therein with a stagnation chamber 38 in which a cooling water discharged from the cylinder block 10 remains, and a temperature-sensing unit 52 of the sub-thermostat 50 is positioned in the stagnation chamber 38. The stagnation chamber 38 communicates with a cooling water discharge passage of the cylinder head, i.e., a high temperature passage 32 via a confluence passage 36, where the confluence passage 36 is slantly connected to the cooling water discharge passage of the cylinder head, i.e., to the high temperature passage 32. The sub-thermostat 50 is mounted at the sub-thermostat housing 37 so that the longitudinal direction of the sub-thermostat 50 can be arranged in parallel with the high temperature passage 32.

The sub-thermostat 50 is resiliently supported via a return spring 54 mounted around the temperature sensing unit 52 and is mounted with a valve seat 56 for opening and closing the flow passage. The valve seat 56 is equipped with a through hole 35 functioning as a bypass passage such that a small quantity of the cooling water inside the first cooling water passage 12 can be discharged to the high temperature passage 32 via the confluence passage 36. The through hole 35 is oppositely formed from the high temperature passage 32 so that the temperature-sensing unit 52 can fully detect the cooling water discharged from the cylinder block.

Furthermore, the sub-thermostat housing 37 is attachably and detachably coupled at a lateral surface thereof with a cap 39 having therein a void of predetermined size and forms the stagnation chamber 38 with the cap 39. The cap 39 also serves to easily attach and detach the sub-thermostat 50.

As a result, because the stagnation chamber 38 is formed so as to keep a predetermined amount of cooling water disposed with the temperature sensing unit 52 of sub-thermostat 50, the temperature-sensing unit 52 can adjust the opening and closing of the valve seat 56 in response to the temperature of the cooling water staying within the stagnation chamber 38 that is discharged to the branch channel 36 from the first cooling water passage 12 via the through hole 35 of the valve seat 56. In other words, the temperature sensing unit 52 of the sub-thermostat 50 can adjust the opening and closing of the valve seat 56 by the influence of only the temperature of the cooling water staying within the stagnation chamber 52. This is because the high temperature cooling water discharged from the second cooling water passage 22 is restricted from inflow into the confluence passage 36 by the cooling water of the stagnation chamber 38 discharged from the first cooling water passage 12.

As a result, even when the cooling water at the cylinder head 20 side suddenly drops to a relatively low temperature while the temperature of the cooling water at the cylinder block 10 side is high, as in the case where a vehicle ascends and descends on a steep hill, the sub-thermostat 50 of the temperature-sensing unit 52 is influenced only by the temperature of the cooling water at the cylinder block 10 side staying within the stagnation chamber 38 so as to maintain an opened state, such that flow of the cooling water inside the first cooling water passage 12 can be maintained via the opened sub-thermostat 50, thereby preventing thermal damage to the cylinder at the cylinder block 10 side and the like.

In an engine equipped with the sub-thermostat 50 thus described, the sub-thermostat 50 can maintain the closed state in response to the temperature of the cooling water inside the first cooling water passage 12 during an initial cold running of the engine to thereby shorten the engine warm-up time. As a result, the activation temperature of the catalyst inside a catalytic converter in an engine's exhaust system can be lowered to reduce the amount of harmful elements in exhaust gas discharged during an initial running of the engine.

Furthermore, because the warm-up period is shortened in the initial stage of engine operation, the viscosity of lubrication oil can be lowered in a short period of time and friction between a cylinder and a piston can be also reduced, thereby promoting more efficient fuel consumption.

As is apparent from the foregoing, there is an advantage in the cooling system for an engine thus described according to the embodiment of the present invention in that a sub-thermostat 50 for shortening a warm-up period of an engine by restricting flow of the cooling water inside a cylinder block 10 during an initial cold driving of the engine is positioned at a stagnation chamber 38 for keeping a predetermined quantity of cooling water at the lateral surface of the cylinder block 10, such that the opening and closing of the sub-thermostat thermostat 50 are influenced only by the temperature of the cooling water at the cylinder block 10 side, thereby enabling an accurate adjustment of the opening and closing of the sub-thermostat 50.

What is claimed is:

1. A cooling system for an engine equipped with a main thermostat and a sub-thermostat for individually controlling the flow of cooling water in a cylinder block and a cylinder head, wherein a stagnation chamber, where cooling water discharged from said cylinder block remains stagnant, is installed inside a sub-thermostat housing mounted with a sub-thermostat, and said stagnation chamber is positioned therein with a temperature sensing unit of said sub-thermostat and said stagnation chamber communicates with a cooling water discharge passage of said cylinder head via a confluence passage.

2. The system of claim 1, wherein a cap is attachably and detachably coupled at a lateral surface of said sub-thermostat housing.

3. The system of claim 1, wherein said confluence passage is slantly connected to the cooling water discharge passage of said cylinder head.

4. The system of claim 1, wherein a longitudinal direction of said sub-thermostat is arranged parallel with the cooling water discharge passage of said cylinder head.

5. The system of claim 1, wherein said sub-thermostat is opened and closed by the temperature of the cooling water discharged from said cylinder block, and by the pressure difference between a cooling water passage of said cylinder block and the cooling water passage of said cylinder head.

6. A cooling system for an engine mounted with a main thermostat and a sub-thermostat for individually controlling the flow of cooling water in a cylinder block and a cylinder head, wherein a sub-thermostat housing mounted with said sub-thermostat is formed with a confluence passage communicating with a cooling water discharge passage of said cylinder head, and a through hole formed at a valve seat of said sub-thermostat is oppositely formed from the cooling water discharge passage of said cylinder head.

7. The system of claim 6, wherein a longitudinal direction of said sub-thermostat is arranged parallel with the cooling water discharge passage of said cylinder head.

8. The system of claim 6, wherein said confluence passage is slantly connected to the cooling water discharge passage of said cylinder head.

* * * * *